United States Patent [19]

Ziegler

[11] Patent Number: 4,535,727

[45] Date of Patent: Aug. 20, 1985

[54] HEAT EXCHANGER WITH ADJUSTABLE PLATFORM FOR CLEANING AND REPAIRING

[75] Inventor: Georg Ziegler, Winterthur, Switzerland

[73] Assignee: Sulzer Brothers Limited, Winterthur, Switzerland

[21] Appl. No.: 628,473

[22] Filed: Jul. 6, 1984

[30] Foreign Application Priority Data

Jul. 7, 1983 [CH] Switzerland ..... 3730/83

[51] Int. Cl.[3] ..... F22B 1/02; F27D 1/16

[52] U.S. Cl. ..... 122/32; 122/7 R; 432/76; 432/3; 165/5; 165/76

[58] Field of Search ..... 122/32, 33, 7 R; 432/3, 432/75, 76; 165/5, 76

[56] References Cited

U.S. PATENT DOCUMENTS

| | | | |
|---|---|---|---|
| 2,966,348 | 12/1960 | Hofmeister | 432/76 |
| 4,221,537 | 9/1980 | Mamula et al. | 432/3 |
| 4,309,196 | 1/1982 | Vollhardt | 122/32 |
| 4,314,826 | 2/1982 | Vollhardt | 122/32 |
| 4,375,956 | 3/1983 | Braudenburg et al. | 432/3 |

*Primary Examiner*—Henry C. Yuen

*Attorney, Agent, or Firm*—Kenyon & Kenyon

[57] ABSTRACT

The synthesis gas cooler is provided with a movable platform in the space between the inner and outer flue. The platform may be constructed in segments with separate cable and winch means provided for raising and lowering of the platform segments via suspension structures. The suspension structures may also be secured in a raised position by bars which pass through fittings at the upper end of the suspension structures and which are supported in a partition above the movable platform.

11 Claims, 4 Drawing Figures

HEAT EXCHANGER WITH ADJUSTABLE PLATFORM FOR CLEANING AND REPAIRING

This invention relates to a heat exchanger. More particularly, this invention relates to a heat exchanger for gases. Still more particularly, this invention relates to a gas cooler for synthesis gas.

Heretofore, various types of heat exchangers, such as gas coolers for synthesis gas, have been known. For example, one known type of construction includes a pair of vertical coaxial gas flues which are formed by straight welded-together wall tubes which extend lengthwise of the flues and through which a cooling medium flows. In addition, at least one spigot or gas lead-through is disposed at an upper end of the heat exchanger to communicate with a central chamber formed by the inner flue while a similar spigot or gas lead-through is provided at the same end to communicate with the space between the flues. Further, at least one orifice is provided in the inner flue near the lower end of the flues so as to communicate the central chamber bounded by the inner flue with the space between the two flues. In this way, a synthesis gas can be introduced and passed downwardly through the central chamber and, thence, passed upwardly through the space between the flues for exiting from the spigot communicating with the space between the flues. These heat exchangers have also been provided with suitable collectors for the wall tubes of the flues.

In cases where sticky solids are present in the gases circulating through the heat exchanger, pre-cleaning the walls is often necessary. However, inspection and maintenance of the gas flue walls lining the space between the two flues of this type of heat exchanger is very difficult. A very extreme example of this state of affairs occurs in the cooling of a synthesis gas. Specifically, during such a process, the melting point of fly ash is reached so that some of the fly ash is in a very sticky state and, therefore, sticks to the walls of the heat exchanger, i.e. gas cooler.

It is also known that the length of the downtime necessary to carry out an inspection and maintenance of the walls of a gas cooler depends on how simple or difficult access to the walls is. In the past, it has been known to provide at least one manhole in the top zone of the gas cooler so that personnal and/or equipment and cleaning material may pass through the manhole into the space between the flues by being lowered via special lifting devices. In other cases, ladders have been provided so that the maintenance personnel are able to climb down into the space between the flues. However, this kind of access makes the maintenance and inspection work time—consuming, difficult, unpleasant and risky.

Accordingly, it is an object of the invention to provide a heat exchanger which requires a minimum downtime for inspection and maintenace.

It is another object of the invention to provide a heat exchanger with relatively simple means for providing access to the interior for maintenance and inspection purposes.

Briefly, the invention provides a heat exchanger which is constructed of a pressure vessel, a pair of concentric coaxial vertical flues which are disposed within the vessel in spaced relation to define an annular space therebetween, at least one spigot or lead-through communicating with a central chamber defined by the inner flue at one end of the vessel and at least one spigot or lead-through communicating with the space between the flues at the same end of the vessel. In addition, the heat exchanger is provided with an annular platform which is disposed within the space between the flues, means for moving the platform vertically between the flues and at least one manhole in the pressure vessel between the spigots for providing access to the space between the flues.

The platform which is horizontal or substantially horizontal has dimensions and a shape which substantially corresponds to the cross-section of the space between the flues.

With the vertical flues being formed of vertical wall tubes for passage of a cooling medium or the like therethrough, the platform can be positioned at an optimum for that part of the walls which are to be inspected or cleaned. This ensures optimum working conditions at the working station where the work is to be performed.

The use of the platform also provides considerable improvement for repair work in cases which, for instance, a welding machine has to be introduced into the space between the flues.

The platform may be thermally insulating so as to provide considerable insulation of one end of the space from the heat in the remainder of the space.

The means for moving the platform may also be removable from the pressure vessel. In this case, means are provided for securing the platform in place between the manhole and the lead-through communicating with the space between the flues. In this way, the particularly heat-sensitive part of the heat exchanger is protected against excessive heat even during operation of the heat exchanger. Further, in order to preclude gas leakage from the space, a horizontal partition can be disposed above the platform between the platform and spigot communicating with the annular space while being disposed between the flues to seal off the space. This partition may also be provided with at least one closeable aperture so as to provide access to and from the space above the platform.

The heat exchanger may have collectors connected to the wall tubes of the outer flue at one end between the manhole and the spigot communicating with the annular space while collectors are connected to the wall tubes of the inner flue at the same end between the manhole and the spigot communicating with the central chamber. This provides for a very simple arrangement of the wall tubes which form the outer flue.

The platform may also be subdivided into at least two segments, each of which is movable and positionable independently of the other. This permits use of some of the platform as a temporary stationary working station while the remainder of the platform serves as a means of transport between the manhole and the working station.

These and other objects and advantages of the invention will become more apparent from the following detailed description taken in conjunction with the accompanying drawings wherein.

Figure 1:
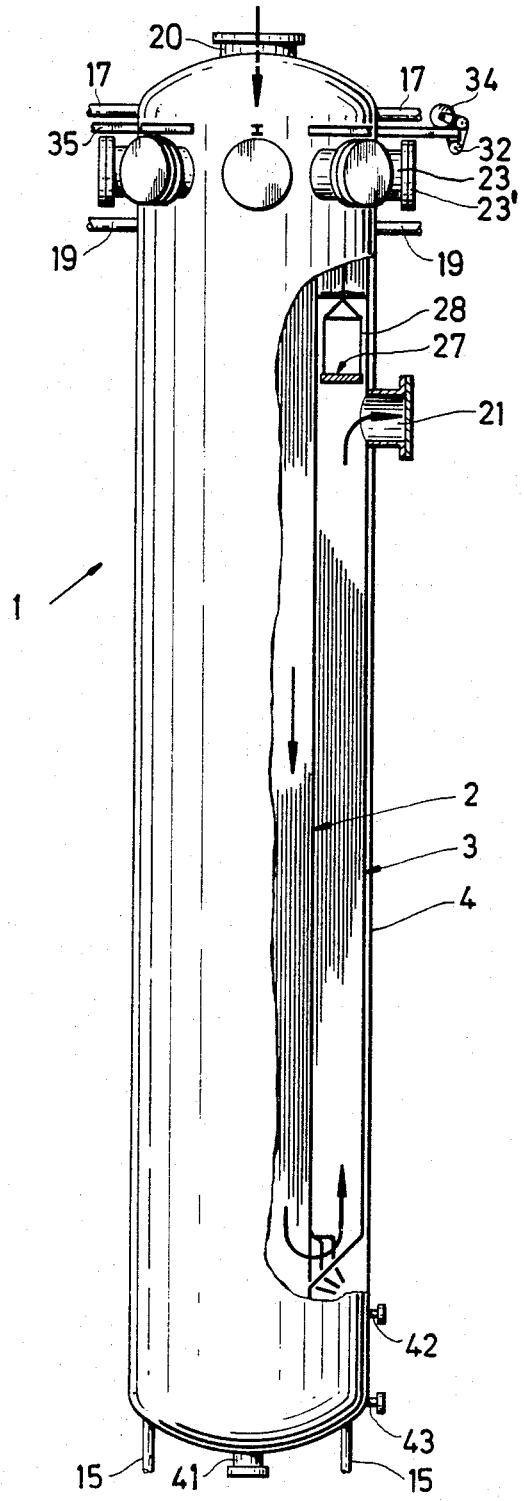
FIG. 1 illustrates a part cross-sectional view of a heat exchanger constructed in accordance with the invention.
Figure 2:
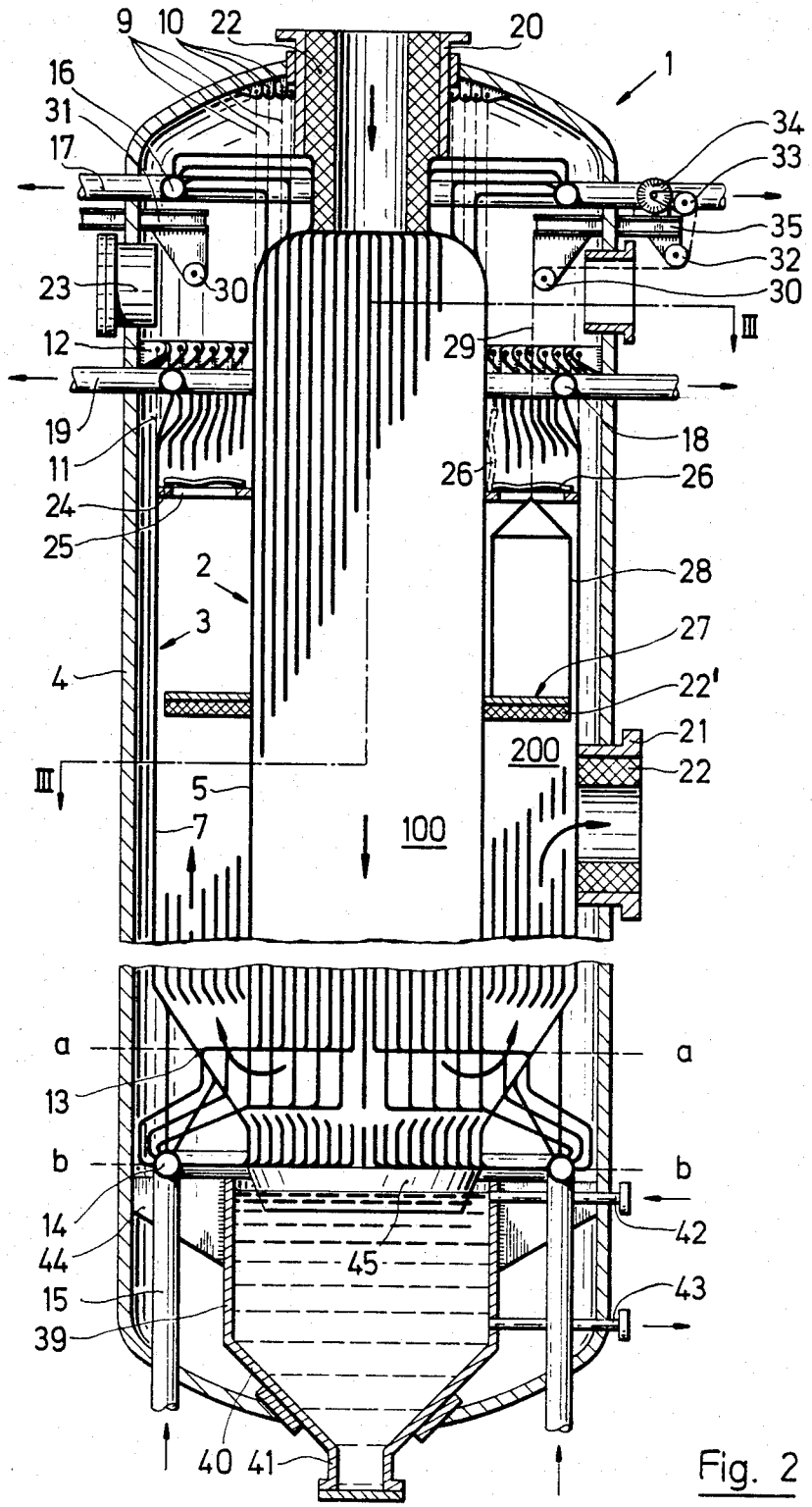
FIG. 2 illustrates a cross-sectional view of the heat exchanger taken on line II—II of FIG. 3.
Figure 3:
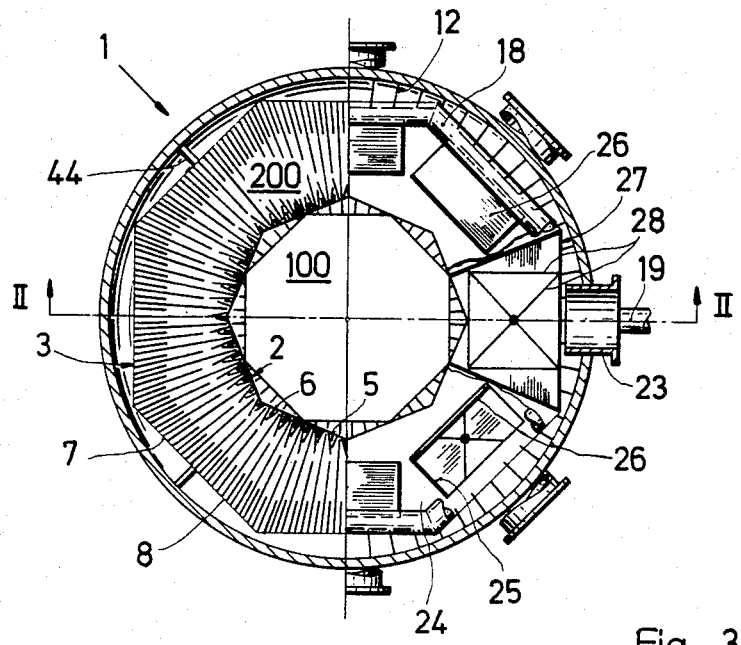
FIG. 3 illustrates a horizontal sectional view taken on line III—III of FIG. 2.

Referring to FIG. 1, the heat exchanger is constructed in the form of a synthesis gas cooler 1. In this regard, the gas cooler includes a vertical cylindrical pressure vessel 4 within which a pair of concentric and coaxial vertical flues 2, 3 are disposed in spaced relation to define an annular space 200 therebetween. As indicated in FIGS. 1, 2 and 3, the inner flue 2 is in the form of a prism to define a central chamber 100. The outer flue 3 is also in the form of a prism.

The function of the pressure vessel is to withstand the substantial pressure differences between a gas entering into the vessel 1 and the surroundings whereas the pressure differences around the flues 2, 3 remain relatively low. This latter feature greatly simplifies the construction and production of the flues 2, 3.

Referring to FIG. 2, the octagonal inner flue 2 is formed of wall tubes 5 which extend lengthwise of the flue and are welded together by way of webs 6 to form a gas-tight wall. As indicated in FIG. 2, the inner flue 2 is suspended by cables 9 on lugs 10 secured to a top end of a pressure vessel 4.

In a similar manner, the outer flue 3 is octagonal and is formed of wall tubes 7 which are welded together by way of webs to form a gas tight wall. The outer flue 3 is also suspended by cables 11 from lugs 12 which are welded to a vertical wall of the pressure vessel 4.

The two coaxial flues 2, 3 are staggered in rotation relative to one another by an angle of 22.5°.

As shown in FIG. 2, the bottom part of the cooler 1, the outer flue 3 merges into a downwardly narrowing pyramidal frustum 13 from which the wall tubes 7 are bent outwardly according as the side surfaces of the frustum 13 narrow. All the wall tubes 7 extend finally, after leaving the frustum 13, to a distributor 14 having a center line forming an octagon parallel to the contour of the outer flue 3. At least two vertical cooling water supply tubes 15 are connected to the distributor.

Some of the tubes 5 are bent outwardly at a height a in the bottom part of the inner flue 2 to extend horizontally in radial planes to bends which extend initially vertically. Consequently, all the wall tubes 5 of the inner flue 2 extend from the level a along vertical radial planes, distributed uniformly over the cooler periphery, in the space between the flue 2 and the frustum 13 of the flue 3.

Large flow orifices for the gas therefore arise at the bottom end of the inner flue 2 and communicate the central chamber 100 with the space 200. In their further extent, the tubes 5 extend through the webs 8 between the tubes 7 of the frustum 13 and extend to the distributor 14. The tubes 5 are sealingly welded to the webs 8 at the place where they extend through the webs 8. Downwardly of the level a, the webs 6 of the inner flue 2 disappear, so that the tubes 5 are sufficiently flexible in this zone to compensate for differences in the heat expansion of each flue 2, 3. However, the webs 8 of the frustum 13 terminate at a lower level b while the bottom end of the frustum 13 merges into a metal plate dip wall 45.

In their top part, the wall tubes 5 of the inner flue 2 extend to a collector 16 to which at least two radially outwardly directed discharge lines 17 are connected. The tubes 7 of the outer flue 3 terminate in their top part in a collector 18 to which at least two radially outwardly extending discharge lines 19 are connected. The two collectors 16, 18 have the same shape and the same extent as the distributor 14 and extend parallel thereto, collector 18 being below collector 16.

A gas entry connection, spigot or lead-through 20 communicates with the central chamber 100 in the inner flue 2 and extends through the center of the top end of the vessel 4. A gas exit spigot or lead-through 21 communicates with the annular space 200 between the flues 2, 3 and extends through the top part of the wall of the vessel 4. The two spigots 20,21 are covered internally by a heat-insulating material 22. In the vertical zone between the collectors 16, 18, the pressure vessel 4 is formed with eight manholes or passages 23 which are distributed uniformly over the pressure vessel periphery and which can be closed by covers 23' (visible only in FIG. 1).

A horizontal partition 24 provides a gas-tight closure of the space 200 below the collector 18 and is formed with eight rectangular apertures 25 each disposed below a manhole 23. The width of each aperture 25 is equal to the diameter of the associated manhole 23 and the length is equal to twice diameter. A cover 26 is provided for each aperture 25, is connected by hinges to the partition 24 and serves to open and close the aperture 25. Means (not shown) are used to provide a gas-tight closure of the aperture 25 in a conventional manner. The partition 24 and the covers 26 are corrugated and made of relatively thin sheet metal so as to be able to take up the different heat expansions of the inner flue 2 and outer flue 3.

A platform 27 subdivided into eight segments is disposed in the space 200 immediately above the gas exit spigot 21. As indicated in FIG. 3, the platform 27 is of annular shape and is disposed concentrically of the flues 2, 3.

In addition, a means is provided for moving the platform 27 vertically between the flues 2, 3. This means includes a suspension structure 28 secured to each respective platform segment and a cable 29 which is removably secured to and which extends from each respective suspension structure 28. As shown in FIG. 2, each cable 29 extends upwardly through an aperture 25 in the partition 24 by way of a first deflecting roller 30 and a second deflecting roller 32 to a winch 33 which is driven by an electric motor 34. As indicated, each roller 30 is mounted on a support 31 which is secured to the inside of the pressure vessel 4 above the manhole 23. Each roller 32 with the associated winch 33 and motor 34 is disposed on the support 35 rigidly secured to the outside of the pressure vessel. The supports 31, 35 are each associated with a platform segment and are disposed at substantially the same height, i.e. below the collector 16. Since the cable 29 extends through the manhole 23 between the rollers 30, 32, the cable 29 must be removed when the associated cover 23' is fitted to the manhole 23. At this time, the cable 29 can be reeled onto the winch 33.

A means is also provided for securing the platform 27 in place between the manhole 23 and the spigot 21 communicating with the outer flue 3. This means includes a pair of opposed grooves 38 in the partition 24 adjacent a respective aperture 25 and a thick round bar or rod 37 which extends across the aperture and is seated in the grooves 38 without impairment of closure of the cover 26. In this regard, the bar 37 is passed through a lug 36 extending centrally of the suspension structure 28 in order to suspend the structure 28 therefrom.

Once a support structure 28 has been moved into the upper position adjacent to the partition 24, the bar 37 can be passed through the lug 36 so as to fix the structure 28 in place. At this time, the cable 29 can then be removed.

Referring to FIG. 3, each platform segment has the shape of a pentagon with one re-entrant corner which is adjacent one edge of the inner flue 2 and is guided on such edge. The area of each pentagon is approximately one-eighth of the annular cross-section of the space 200. Consequently, all eight segments together are adapted to the size and shape of the cross-section of the space 200. For improved guidance, the platform segments may also have wheels which have a horizontal axis of rotation and which run on the walls of the flues 2, 3. Each platform segment may also be thermally insulating by providing a layer of heat insulation 22′ on the under side. This layer of insulation 22′ not only protects the platform 27 but also that part of the space 200 which is above the platform 27 from the relatively high temperature of the emerging gas (approximately 700° C. in normal operation).

Referring to FIG. 2, a water filled vessel 39 is disposed below the frustum 13 in the pressure vessel 4. This water-filled vessel 39 merges at the bottom end into a funnel 40 and an associated emptying connection 41. A circulator (not shown) serves to convey the water through the vessel 39. To this end, the vessel 39 has a water inlet 42 and a water outlet 43 as indicated. A line receiving the circulator comprises a cooling and cleaning facility (not shown) while the vessel 39 is supported by way of at least three plates 44 on the wall of the pressure vessel 4.

The heat exchanger may be constructed so that the space 200 between the flues 2, 3 is, for example, sixteen meters high and sixty centimeters in annular width.

The synthesis gas cooler 1 operates as follows.

In normal operation, the synthesis gas to be cooled passes through the spigot or gas inlet 20 into the central chamber 100 and flows downwardly. The gas is then deflected in the orifices of the inner flue 2 and flows upwardly through the space 200 to leave the cooler 1 by way of the gas outlet or spigot 21. During this time, cooling water is supplied through the tubes 15 to the distributor 14 to flow upwardly through the tube walls 5, 7 so as to extract heat from the gas. The heated water then passes through the collector 16, discharge line 17, collector 18 and discharge lines 19 to leave the cooler 1.

Between the gas inlet spigot 20 and gas outlet spigot 21, the synthesis gas is cooled from approximately 1500° C. to approximately 700° C. and thus passes through, at around 1200° C., the melting point of fly ash present in the gas. The fly ash is to some extent in a sticky stage at this temperature. Some of the sticky fly ash is thus deposited on the walls of the flues 2, 3 while the remainder is separated out together with other possible solid impurities of the gas into the water filled vessel 39 by gravity. Lumps of ash which stick to the parts of the flue walls and which occassionally become detached during operation, may drop into the water in the vessel 39 either directly from the central chamber 100 or by way of the funnel-like frustum 13 from the space 200.

Figure 4:
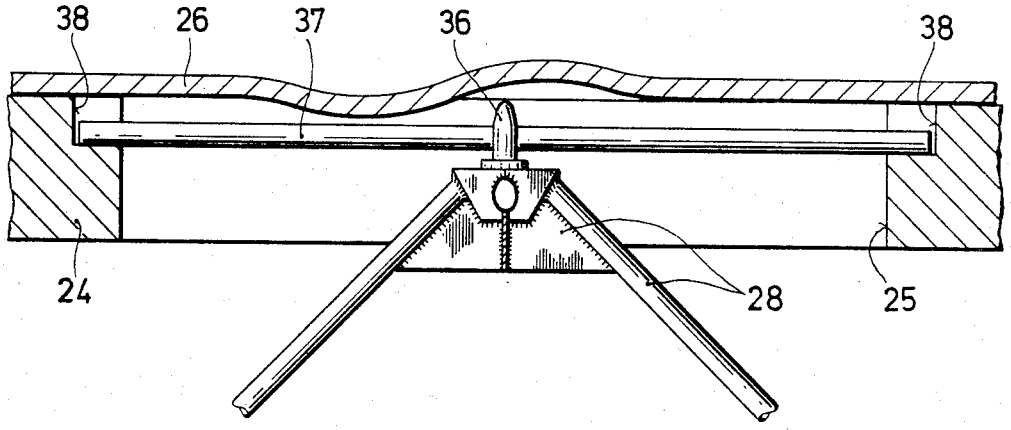
FIG. 4 illustrates a view of a means for securing the platform in place.

The circulator circulates water by way of the water outlet 43 and water inlet 42 from the vessel 39 through the cooling and cleaning facility and back to the vessel 39. The wall 45 provides a gas-tight separation of the central chamber 100 and space 200 from the surrounding pressure vessel inner spaces so that a pressure equalization can be carried out in a controlled and known manner in the interior spaces of the pressure vessel 4. When servicing and/or repair work become necessary, the gas cooler is stopped and cooled. Thereafter, the covers 23′ are removed from the manholes 23. The partition 24 is then accessible so that the covers 26 can be opened. After opening, the cables 29 are unreeled from the winches 33 and guided over the rollers 32, 30 to be secured to the suspension structures 28 attached to the platform segments. The motors 34 are then actuated to raise the platform segments slightly. Thereafter, the bars 37 (see FIG. 4) are removed so that the segments are then ready for operation.

Personnel may then pass through the manholes 23 and openings 25 onto the platform 27 with any material needed for the work in hand loaded onto the platform. Each platform segment is approximately large enough for half to accommodate one person plus tools, cleaning and repair material. Weight must be distributed so that each segment remains substantially balanced if the segments are guided by wheels, weight distribution is less critical.

A number of platform segments may be rigidly interconnected to provide an increased working area. In this case, the motors 34 of the interconnected segments must be synchronized with one another. The platform segments can then be lowered and stopped at the most appropriate height for performing the work. Some of the segments may also be used as a means of transportation between the segments serving as a working station and the manholes 23.

Upon completion of the work, the platform segments are returned to their stationing position and secured therein by the bars 37 as indicated in FIG. 1. Thereafter, the cables 29 are removed from the interior of the pressure vessel 4. The openings 25 and manholes 23 are then reclosed in gas-tight manner by means of the covers, 26, 23′, respectively, and the cooler 1 can resume normal operation.

In the course of time, some heavy soiling collects in the funnel 40 of the tank 39. When the soil in the funnel 40 reaches a critical maximum, possibly after extensive cleaning has been performed inside the pressure vessel 4, the emptying connection 41 is opened while the plant is inoperative and the tank 39 cleaned from the inside.

Of note, for cleaning of the central chamber 100, access may be made by way of the gas inlet spigot 20.

Soiling of the flue walls can be reduced very considerably if some of the wall tubes 5, 7 are made as flushing or washing tubes. To this end, these tubes would be made of greater diameter than the other wall tubes and would be formed with apertures for spraying directed jets of water. The directions of the jets would be such that the jets cover the largest possible area of the flue walls. This feature has the additional advantages that cooling is improved and, in particular, that the gas is scrubbed and leaves the synthesis gas cooler with a high degree of purity.

It is not essential for the cables 29 to extend through the manholes 23 although this feature is particularly convenient with respect to access. For instance, the cables 29 could extend through special passages in the top end of the pressure vessel 4. Alternatively, suspension means could be provided above the openings 25 inside the pressure vessel 4 and, after opening of the manholes 23, the complete drive means for the platform segments could be suspended on such means.

The electric motors 34 are not absolutely essential and the platform segments could in some circumstances be raised and lowered manually. In any case, it is advisable to take every possible safety precaution such as having two independently useable cables for each platform segment, automatic safety brakes on the platform segments and the possibility of operating the winches 33 manually at any time.

The cables 9, 11 used to suspend the flues 2, 3 can be replaced by support or carrying tubes through which water may flow in known manner to thus aid in cooling the top space of the pressure vessel 4.

The invention thus provides a heat exchanger of relatively simple construction which can be inspected and maintained in a rapid and efficient manner. Further, the invention provides a synthesis gas cooler which can be cleaned with a minimum of downtime.

What is claimed is:

1. A heat exchanger comprising a pair of coaxial vertical flues disposed in spaced relation to define an annular space therebetween with the inner flue defining a central chamber, each said flue including wall tubes for passage of a medium therethrough;

at least one gas lead-through communicating with said central chamber at one end of the heat exchanger;

at least one gas lead-through communicating with said annular space at said one end of the heat exchanger;

at least one orifice in said inner flue communicating said central chamber with said annular space at an opposite end of the heat exchanger;

an annular platform disposed within said space coaxial of said flues;

means for moving said platform vertically between said flues; and at least one manhole between said gas leadthroughs for providing access to said space.

2. A heat exchanger as set forth in claim 1 wherein said platform is thermally insulating.

3. A heat exchanger as set forth in claim 1 wherein said means is removable from the heat exchanger and which further comprises means for securing said platform in place between said manhole and said lead-through communicating with said annular space.

4. A heat exchanger as set forth in claim 1 which further comprises a horizontal partition above said platform and between said manhole and said lead-through communicating with said annular space, said partition being disposed between said flues to seal off said space and having at least one closable aperture therein.

5. A heat exchanger as set forth in claim 1 which further comprises collectors connected to said wall tubes of said outer flue at said one end and between said manhole and said lead-through communicating with said annular space and collectors connected to said wall tubes of said inner flue at said one end and between said manhole and said lead-through communicating with said central chamber.

6. A heat exchanger as set forth in claim 1 wherein said platform is subdivided into at least two segments, said segments being movable and positionable independently of one another.

7. A heat exchanger comprising a pressure vessel;

a pair of concentric vertical flues disposed within said vessel in spaced relation to define an annular space therebetween with the inner flue defining a central chamber;

at least one spigot in said vessel communicating with said central chamber at one end of said vessel;

at least one spigot in said vessel communicating with said space at said end of said vessel;

an annular platform disposed within said space concentrically of said flues;

means for moving said platform vertically between said flues; and at least one manhole in said vessel between said spigots for providing access to said space.

8. A heat exchanger as set forth in claim 7 which further comprises a horizontal partition above said platform and between said manhole and said platform, said partition being disposed between said flues to seal off said space and having at least one aperture therein, and a cover for opening and closing said aperture.

9. A heat exchanger as set forth in claim 7 wherein said platform is subdivided into segments and wherein said means includes a suspension structure secured to a respective platform segment, a cable removably secured to and extending from said suspension structure through said manhole and a winch mounted outside said vessel for reeling of said cable thereon.

10. A heat exchanger as set forth in claim 9 which further comprises a horizontal partition above said platform and between said manhole and said platform, said partition being disposed between said flues to seal off said space and having at least one aperture therein for passage of said cable, a pair of opposed grooves in said partition adjacent said aperture and a bar extending across said aperture and seated in said grooves with said suspension structure suspended therefrom.

11. A heat exchanger as set forth in claim 10 which further comprises a cover for opening and closing said aperture.

* * * * *

UNITED STATES PATENT AND TRADEMARK OFFICE

CERTIFICATE OF CORRECTION

PATENT NO. : 4,535,727

DATED : August 20, 1985

INVENTOR(S) : GEORG ZIEGLER

It is certified that error appears in the above-identified patent and that said Letters Patent is hereby corrected as shown below:

Column 2, line 20 change "provides considerable" to -provides a considerable-

Column 2, line 21 change "cases which" to -cases in which-

Column 3, line 63 change "The tubes 7" to -The wall tubes 7-

Column 4, line 19 change "twice diameter" to -twice such diameter-

Signed and Sealed this

*Fourteenth* Day of *January 1986*

[SEAL]

*Attest:*

DONALD J. QUIGG

*Attesting Officer*

*Commissioner of Patents and Trademarks*